US008203106B2

(12) United States Patent
Kataoka et al.

(10) Patent No.: US 8,203,106 B2
(45) Date of Patent: Jun. 19, 2012

(54) INDUCTION HEATING APPLIANCE FOR COOKING

(75) Inventors: Akira Kataoka, Hyogo (JP); Toshihiro Keishima, Hyogo (JP); Yasushi Morimoto, Hyogo (JP)

(73) Assignee: Panasonic Corporation, Osaka (JP)

( * ) Notice: Subject to any disclaimer, the term of this patent is extended or adjusted under 35 U.S.C. 154(b) by 321 days.

(21) Appl. No.: 12/665,973

(22) PCT Filed: Jun. 23, 2008

(86) PCT No.: PCT/JP2008/001612

§ 371 (c)(1),
(2), (4) Date: Dec. 22, 2009

(87) PCT Pub. No.: WO2009/001538

PCT Pub. Date: Dec. 31, 2008

(65) Prior Publication Data

US 2010/0206871 A1 Aug. 19, 2010

(30) Foreign Application Priority Data

Jun. 22, 2007 (JP) ..... 2007-164615

(51) Int. Cl.
*H05B 6/12* (2006.01)

(52) U.S. Cl. ..... 219/620; 219/622; 219/624; 219/627

(58) Field of Classification Search ..... 219/620, 219/621, 624, 647, 622, 627, 660, 667, 443.1, 219/446.1, 448.11; 126/220, 221; 99/DIG. 14
See application file for complete search history.

(56) References Cited

U.S. PATENT DOCUMENTS

| | | | | |
|---|---|---|---|---|
| 6,225,607 | B1 * | 5/2001 | Has et al. | 219/448.11 |
| 2005/0242088 | A1 | 11/2005 | Takada et al. | |
| 2006/0049178 | A1 | 3/2006 | Tominaga et al. | |

FOREIGN PATENT DOCUMENTS

| | | | |
|---|---|---|---|
| EP | 1983804 | A1 * | 10/2008 |
| JP | 2002-075624 | | 3/2002 |
| JP | 2003-317920 | | 11/2003 |
| JP | 2004-095316 | | 3/2004 |
| JP | 2004-227976 | | 8/2004 |
| JP | 2005-026162 | | 1/2005 |
| JP | 2005-038660 | | 2/2005 |

(Continued)

OTHER PUBLICATIONS

International Search Report issued Sep. 16, 2008 in International (PCT) Application No. PCT/JP2008/001612.

(Continued)

*Primary Examiner* — Henry Yuen
*Assistant Examiner* — Hung D Nguyen
(74) *Attorney, Agent, or Firm* — Wenderoth, Lind & Ponack, L.L.P.

(57) ABSTRACT

An infrared permeable window 4*a*, which is surrounded by a light shielding layer 7*b* and is narrower than an infrared sensor display window 4*g*, is formed inwardly of the infrared sensor display window 4*g*, and an infrared incident area 43*a* for detecting infrared rays of light and a light emitting unit 56*a* are provided below the infrared permeable window 4*a*. Also, a light emitting surface 4*b* is provided inwardly of the infrared permeable window 4*a*, so that the user can assuredly place a cooking container P on the infrared permeable window 4*a*.

2 Claims, 9 Drawing Sheets

FOREIGN PATENT DOCUMENTS

| | | |
|---|---|---|
| JP | 2005-122962 | 5/2005 |
| JP | 2005-302393 | 10/2005 |
| JP | 2005-317305 | 11/2005 |
| JP | 2007-103085 | 4/2007 |

OTHER PUBLICATIONS

International Preliminary Report on Patentability and Written Opinion of the International Searching Authority, issued Jan. 12, 2010, in PCT/JP2008/001612 (in English).

* cited by examiner

INDUCTION HEATING APPLIANCE FOR COOKING

TECHNICAL FIELD

The present invention relates to an induction heating appliance for cooking operable to heat a cooking container by electromagnetic induction, in which an infrared sensor is utilized to control the temperature of the cooking container.

BACKGROUND ART

In recent years, the use of induction heating appliances as fireless cooking devices for cooking has been widely spreading. This type of induction heating appliance for cooking includes an infrared sensor disposed below a center portion of a heating coil and a control unit operable in response to an output from the infrared sensor to control an inverter circuit to thereby control the output of the heating coil (see, for example, Japanese Laid-open Patent Publication No. 2005-38660).

SUMMARY OF THE INVENTION

It has, however, been found that in the induction heating appliance for cooking of the structure discussed above, the infrared sensor fails to properly detect the temperature of a cooking container if the user unwittingly fails to place such cooking container in such a manner as to cover an upper surface region of the infrared sensor. Particularly where the environment around the induction heating appliance is dark, there is a problem that the position of the infrared sensor is hardly ascertained with eyes. Also, a portion of the bottom surface of the cooking container such as, for example, a pan, which is apt to be heated to the highest temperature, is in the vicinity of a portion of the heating coil winding intermediate between the outermost periphery and the innermost periphery of such heating coil winding, at which the highest flux density is attained accompanying large heat generation. Although the induction heating appliance for cooking, which is good in temperature follow-up characteristic, can be made available if the infrared sensor is arranged in proximity to that portion of the heating coil winding, the infrared sensor in such case tends to be arranged at a location offset from the center of the heating coil and, therefore, the possibility would come to be high that the user will not place the cooking container above the infrared sensor, thus resulting in a failure of the infrared sensor to detect the temperature of the cooking container properly.

The present invention has been developed to overcome the above-described disadvantages.

It is accordingly an objective of the present invention to provide an easy-to-handle induction heating appliance for cooking, with which a region, at which infrared radiation emitted from the cooking container can be incident on the infrared sensor, can be easily noticed so that the control of the temperature of the cooking container can be assuredly accomplished with the infrared sensor.

In accomplishing the above objective, the induction heating appliance for cooking according to the present invention includes a body forming an outer shell, a top plate mounted on a top area of the body for support of a cooking container thereon, and a heating coil arranged beneath the top plate in face to face relation with the top plate for generating high frequency magnetic fields necessary to heat by induction a bottom of the cooking container placed on the top plate, in which an infrared sensor display window is provided on the top plate surface, and an infrared permeable window surrounded by a light shielding element and being narrower than the infrared sensor display window is formed inwardly of the infrared sensor display window. Also, an infrared sensor for detecting infrared radiation emanating from the cooking container and a light emitting element are provided below the infrared permeable window so that light emission from the light emitting element can be noticed with eyes at a location inside the infrared permeable window, and a control unit is provided to control an output of the heating coil based on an output of the infrared sensor.

The induction heating appliance for cooking according to the present invention includes an infrared permeable window defined inwardly of an infrared sensor display window and surrounded by a light shielding element so as to have a size narrower than the infrared sensor display window, and an infrared sensor disposed beneath the infrared permeable window for detecting infrared radiation emanating from the cooking container. Since the infrared permeable window allows infrared rays of light to pass therethrough and is provided only on an upper region of the infrared sensor, not only can any undesirable reduction in level of detecting the infrared rays of light emanating from the cooking container such as, for example, a pan, which would otherwise occur when strong ambient light around the induction heating appliance enters the infrared sensor be avoided, but also the infrared sensor display window can be presented large in size to the user to enable him or her to recognize the position of the infrared sensor. Also, even when the cooking container displaces somewhat from the infrared sensor display window, the upper region of the infrared permeable window provides an additional coverage for which the cooking container can cover it and, as a result, the temperature control can be performed stably notwithstanding the displacement of the cooking container, thus resulting in an increase in usability of the induction heating appliance.

Furthermore, with the light emitting element, the position of the infrared sensor can be indicated visually so that the user can assuredly place the cooking container such as, for example, a pan at the position at which the permeable windows for the infrared sensor can be covered. Particularly where the environment is dark, it is indeed effective to provide a visual indication of the position of the infrared sensor by means of the light emitting element.

DETAILED DESCRIPTION OF THE INVENTION

Figure 1:
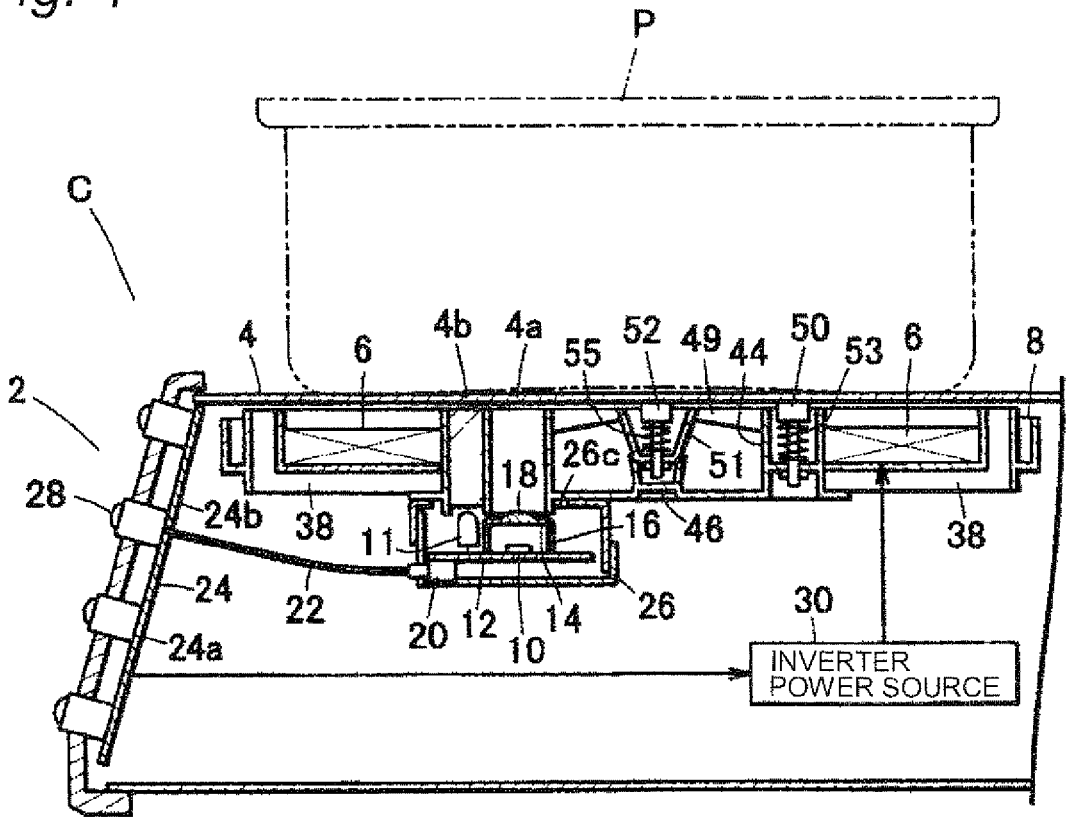
FIG. 1 is a schematic sectional view showing an induction heating appliance for cooking according to a first preferred embodiment of the present invention.

The first invention is so configured that an induction heating appliance for cooking may include a body forming an outer shell, a top plate mounted on a top area of the body and made of a material of a kind capable of passing infrared rays of light therethrough, a heating coil arranged beneath the top plate in face to face relation with the top plate for generating high frequency magnetic fields necessary to heat by induction a bottom of a cooking container placed on the top plate, an infrared sensor for detecting infrared radiation emanating from the bottom of the cooking container in a direction below an infrared permeable window, a light guide element including an infrared radiation receiving member having an opening formed therein in face to face relation with the top plate and also having an optical path defined therein for passing therethrough the infrared rays of light incident from the infrared radiation receiving member towards the infrared sensor, a light emitting unit for emitting visible rays of light towards a rear surface of the top plate, and a control unit for controlling an output of the heating coil based on an output signal of the infrared sensor. In this induction heating appliance, the top plate has a table top surface or a rear surface provided with an infrared sensor display window, and an infrared permeable window, which represents a region surrounded by a light shielding element and is narrower than the infrared sensor display window, is formed inwardly of the infrared sensor display window. Also, the light emitting unit is provided below the infrared permeable window so that light emission of the light emitting unit at a location inwardly of the infrared permeable window can be noticed with eyes.

With the induction heating appliance so constructed as hereinabove described, since the infrared permeable window having a size narrower than the infrared sensor display window and surrounded by the light shielding element at a location inwardly of the infrared sensor display window suppresses an undesirable ingress of strong ambient light (external disturbing light) around the induction heating appliance, it is possible to avoid reduction in performance of detecting the infrared rays of light emanating from the cooking container such as, for example, a pan, which would occur as a result of entry of the ambient light. If the light shielding element is so designed as to be a film having a large light absorbing capability and of a black color or any other color (such as, for example, gray or brown) nearly similar to a dark black color, transmittance of the ambient light after the latter has been reflected within the inside of the top plate can be suppressed and, therefore, an effect of avoiding an undesirable ingress of the ambient light from the infrared incident member can be further increased. Also, to the user, the infrared sensor display window can be displayed large in size, allowing the position of the infrared sensor to be clearly recognized. In addition, even when the cooking container is somewhat displaced from the infrared sensor display window, the upper surface of the infrared permeable window can have an additional coverage for the cooking container to cover it and, as a result, the temperature control can be performed stably relative to the displacement of the cooking container, accompanied by an increase in usability.

Furthermore, when the design is employed in which the rear surface of the lighting window is illuminated by the rays of light emitted from the light emitting unit so that the light emission of the light emitting unit can be noticed inside the infrared permeable window, the position of the infrared sensor can be accurately acknowledged to the user and the cooking container such as, for example, a pan can be assuredly placed at the position at which the cooking container covers the infrared sensor incident member. Particularly where the environment is dark, it is indeed effective for the position of the infrared sensor to be acknowledged with the light emitting unit.

The second invention is so configured that an induction heating appliance for cooking may include a body forming an outer shell, a top plate mounted on a top area of the body and made of a material of a kind capable of passing infrared rays of light therethrough, a heating coil arranged beneath the top plate in face to face relation with the top plate for generating high frequency magnetic fields necessary to heat by induction a bottom of a cooking container placed on the top plate, an infrared sensor for detecting infrared radiation emanating from the bottom of the cooking container in a direction below an infrared permeable window, a light guide element including an infrared radiation receiving member having an opening formed therein in face to face relation with the top plate and also having an optical path defined therein for passing therethrough the infrared rays of light incident from the infrared radiation receiving member towards the infrared sensor, and a light emitting unit for emitting visible rays of light towards a rear surface of the top plate.

In the induction heating appliance so constructed as hereinabove described, an infrared permeable window, which represents a region surrounded by a light shielding element and is narrower than the infrared sensor display window, and a lighting window are separately formed inwardly of the infrared sensor display window, and the light emitting unit is provided below the lighting window so that light emitted by the light emitting unit is projected onto a rear surface of the lighting window. By so designing, the infrared permeable window can be rendered to be a light permeable window dedicated to the infrared sensor, independently of the light permeable window dedicated to the light emitting unit. Therefore, the capability of shielding light around an upper portion of the infrared incident unit can be increased to thereby reduce influences on the infrared sensor, which are brought about by strong light around the induction heating appliance. If the light shielding element is colored in black color or any other color (such as, for example, gray or brown color) nearly similar to a dark black color to have a large light absorbing capability, the ambient light can be prevented from being transmitted after it has been reflected inside the top plate, thus making it possible to further increase an effect of avoiding an undesirable ingress of the ambient light from the infrared incident unit.

Also, although the lighting window is dedicated to the light emitting element, the lighting window lies inside the infrared sensor display and, when viewed by the user, it can be recognized as illuminating the position of the infrared sensor. Accordingly, the position of the infrared sensor can be indicated to the user so that the cooking container such as, for example, a pan may be assuredly placed at the position at which the permeable window for the infrared sensor can be covered.

Hereinafter, some preferred embodiments of the present invention will be described in detail. It is, however, to be noted that the present invention is not necessarily limited to such embodiments as hereinafter described.

First Embodiment

FIG. 1 illustrates, in a schematic sectional representation, an induction heating appliance C for cooking according to a first preferred embodiment of the present invention. As best shown in FIG. 1, the induction heating appliance C of the present invention includes a body 2 forming an outer shell, a top plate 4 mounted on a top area of the body 2 to place thereon a cooking container P such as, for example, a pan, and a generally disc-shaped heating coil 6 arranged beneath the top plate 4 for generating high frequency magnetic fields.

Figure 6:
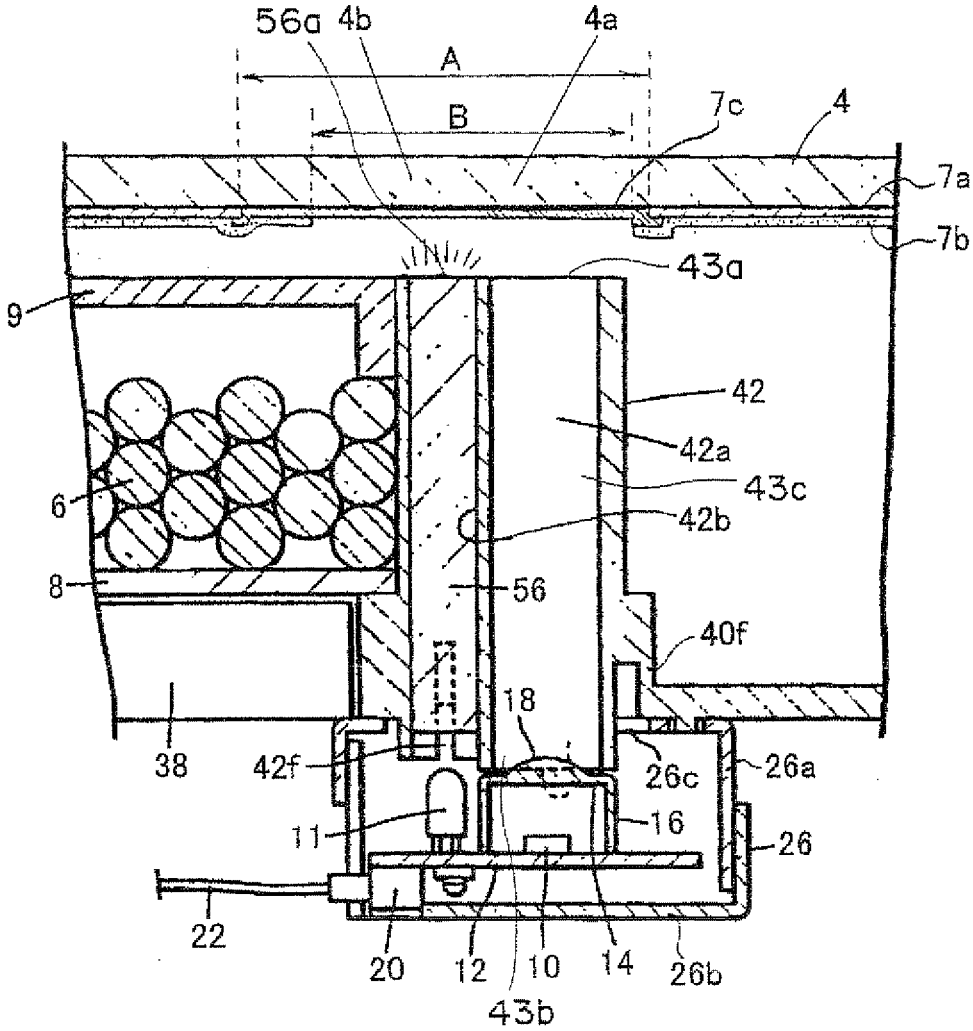
FIG. 6 is a fragmentary enlarged view showing a portion of the induction heating appliance, shown in FIG. 1, around an infrared sensor employed therein.

The top plate 4 referred to above is made of a light transmissible, insulating material such as, for example, crystallized ceramic and is formed into a plate shape. The top plate 4 has a table top surface, or a rear surface opposite to the table top surface, provided with a heating area 5, the perimeter of which is indicated to show where a cooking container P has to be placed (see FIG. 2). The heating area 5 is defined by a colored, for example, silver colored, printed thin film 7*a*, as best shown in FIG. 6, so that a round region can be displayed on a portion of the table top surface or undersurface of the top plate 4, which lies above a top surface of the heating coil 6, in a fashion concentrically with the heating coil 6. A print-removed zone 4*c* indicative of the region of the heating area 5 is represented by an annular shape depicted by a line of a predetermined width at a surface portion of the top plate 4 where the printed thin film 7*a* is not formed, and a black colored light shielding layer 7*b* best shown in FIG. 6 is formed in an outermost (lower) surface of the printed thin film 7*a* as a light shielding member, having a substantially zero light transmittance, in a region about the same as the region of the printed thin film 7*a*.

Figure 2:
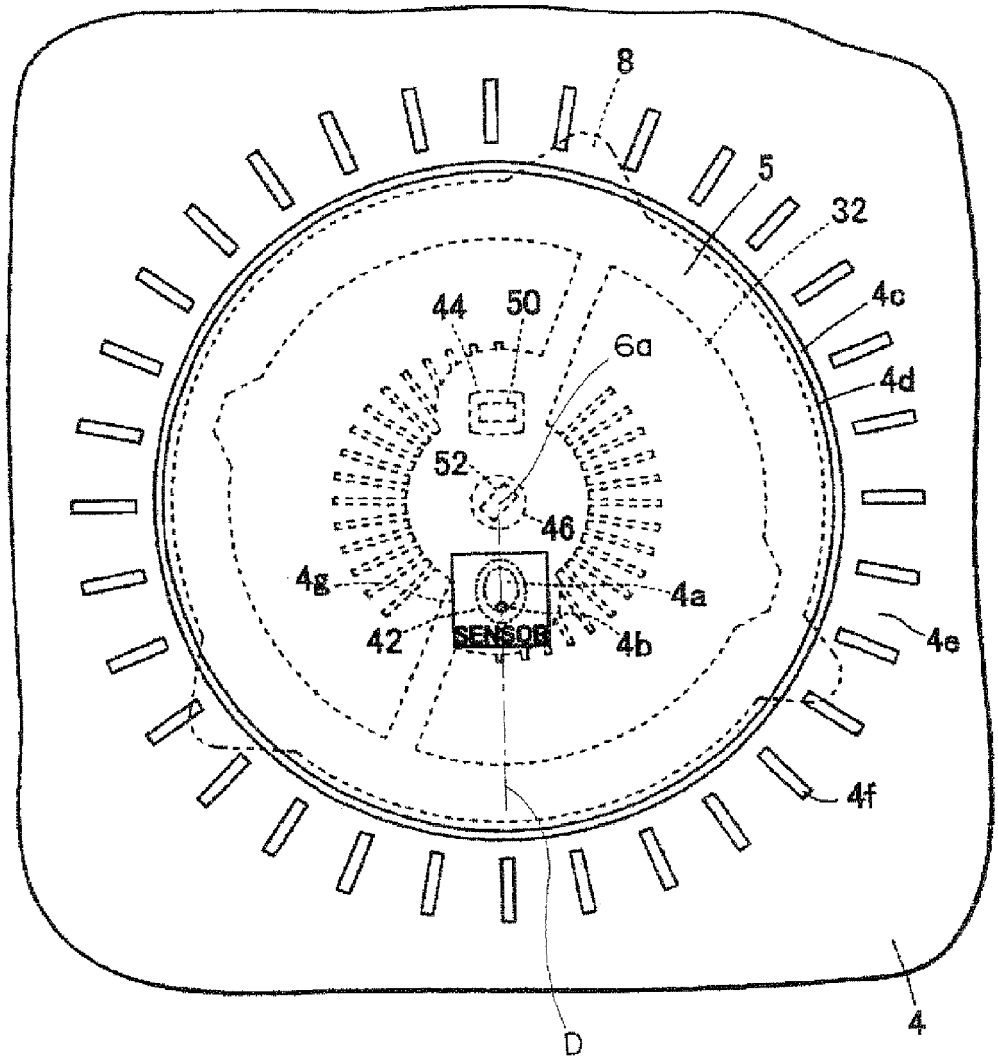
FIG. 2 is a top plan view showing a top plate employed in the induction heating appliance shown in FIG. 1.

It is to be noted that the line-shaped print-removed zone 4*c* may be colored in a color different from that of the surroundings. By way of example, as shown in FIG. 2, a round printed zone 4*d*, defined by the printed thin film 7*a* at a location above the heating coil 6, and a printed zone 4*e* other than a top region of the heating coil 6 may be colored in a silver color whereas the print-removed zone 4*c* may be defined by a transparent printed film or a black or brown colored semitransparent film. Also, a plurality of slits 4*f* of a predetermined length may be provided externally (transversely) around the outer perimeter of the heating coil 6 so as to extend in a radial pattern to show the region of the heating area 5. Those slits 4*f* may be formed in a light transmissible fashion or a portion of the top plate 4 externally around the heating coil 6 may be formed in a light transmissible fashion, and an annular line-shaped light emitting area (not shown) may be provided therebelow so that light emission may be made through the slits 4*f* or externally around the heating coil 6 to display the region of the heating area 5. The shape of each of the printed zone 4*d*, the print-removed zone 4*c* and the slits 4*f* is for the purpose of indicating the region of the heating area 5, and the region of the heating area 5 may be displayed by arbitrarily choosing one or more of them.

A center front portion of the rear surface of the top plate 4, indicative of the heating area 5, is provided with a black colored printed thin film 7*c* capable of transmitting light therethrough and is formed with an infrared sensor display window 4*g* (see FIG. 2), the top plan shape of which represents a generally rectangular shape. In FIG. 6, a region indicated by A represents the infrared sensor display window 4*g*.

The infrared sensor display window 4*g* referred to above is provided with an infrared permeable window 4*a*, positioned at a location confronting an open upper end of a first light guide tube 42*a* (best shown in FIG. 6), as will be described in detail later, so as to be encompassed by such infrared permeable window 4*a*, which window 4*a* is capable of transmitting therethrough infrared radiation emanating from the cooking container P and subsequently detected by an infrared sensor 10. In FIG. 6, a region indicated by B represents the infrared permeable window 4*a*. The infrared permeable window 4*a* has its perimeter encompassed by the light shielding layer 7*b* employed as a light shielding member. Also, as will be described in detail later, the infrared permeable window 4*a* is so formed as to include a light emitting face 4*b*, which is illuminated by a light emitting unit 56*a* with rays of light emitted from, for example, a light emitting diode 11 and which can be noticeably viewed when the top plate 4 is viewed from above.

Within the region of the infrared sensor display window 4*g*, a front portion of the light emitting face 4*b* at one end of a second light guide 42*b*, at which rays of light can be noticeably viewed, bears a legend reading "SENSOR" and, accordingly, the user of the induction heating appliance can easily recognize that the infrared sensor display window 4*g* is a window indicative of the region where temperature measurement with the infrared sensor 10 takes place and that the light emitting face is representative of the region to be covered by the cooking container P that is placed thereon.

The heating coil 6 is mounted on a coil base 8 made of a heat resistant resin or the like and includes a plurality of rod shaped coil holders 9 screwed to the coil base 8 at respective location externally of the perimeter of the heating coil 6, wherefore the heating coil 6 is supported by the coil base 8 with free ends of the coil holders 9 retaining an inner peripheral portion of the heating coil 6. The infrared sensor 10 is disposed beneath the coil base 8 for detecting the temperature of the bottom of the cooking container P that has been positioned at a location forwardly (as viewed from the user participating in cooking) from the center of the heating coil 6. Similarly disposed beneath the coil base 8 is a light emitting unit 56*a* from which illuminating light is emitted towards the top plate 4. The infrared sensor 10 and the light emitting unit 56*a* are so positioned relative to each other that when viewed from above, an infrared radiation receiving member 43*a* for receiving infrared radiation to be transmitted to the infrared sensor 10 may have its center positioned on the imaginary straight line D connecting respective centers of the light emitting unit 56*a* and the heating coil 6 together and at a location substantially intermediate between the center of the light emitting unit 56*a* and the center of the heating coil 6.

Also, the center of the infrared radiation receiving member 43*a* may be positioned in the vicinity of the imaginary straight line D, but at least a portion of the infrared radiation receiving member 43*a* is preferably positioned on the imaginary straight line D. By constructing in this way, placement of the cooking container P so as to cover the light emitting unit 56*a* results in an assured covering of the infrared radiation receiving member 43*a* with the cooking container P. The infrared sensor 10 and the light emitting element 11 are mounted on a substrate (printed circuit board) 12 and are then electrically connected with other electric component parts.

The infrared permeable window 4*a* in the top plate 4 (see FIG. 6) is, when viewed from above, positioned at a location radially inwardly of an inner edge portion of the heating coil 6 in the vicinity of an inner peripheral edge portion of the heating coil 6 and offset from the center of the heating coil 6, and the infrared radiation receiving member 43*a* and the light emitting unit 56*a* are positioned immediately below the infrared permeable window 4*a*.

It is to be noted that the heating coil 6 may be of a split construction including an inner coil and an outer coil and, in such case, the infrared permeable window 4*a* may be arranged inwardly of an outer peripheral edge portion of the heating coil 6 and immediately below a portion intermediate between the inner and outer coils.

Also, a flat plate filter 14 for suppressing passage of visible rays of light is provided above the infrared sensor 10, and a side wall 16 for suppressing passage of the visible rays of light is also provided around the infrared sensor 10. This filter 14 is fitted to the substrate 12 so as to cover the infrared sensor 10 on the substrate 12 through the side wall 16 surrounding the vicinity of the infrared sensor 10, and the filter 14 positioned immediately above the infrared sensor 10 is formed integrally with a convex lens 18 for throttling the field of view of the infrared sensor 10, that is, increasing the amount of infrared rays of light radiating from the cooking container P and incident directly on the infrared sensor 10 by way of the infrared permeable window 4*a* without being reflected by an inner surface of the first light guide tube 42*a*.

An amplifier (not shown) for amplifying an output signal generated from the infrared sensor 10 is mounted on the substrate 12, and the output signal from the infrared sensor 10 is, after having been amplified by the amplifier, fed to a control unit 24*a* through a lead line 22 connected with a connector 20 and then through a temperature converting means 24*b* for converting the amplified output signal of the infrared sensor 10 into a temperature of the cooking container. The control unit 24*a* and the temperature converting means 24*b* are structured on a control substrate 24. It is to be noted that the temperature converting means 24*b* may be structured on the substrate 12. In addition, an operating panel 28 for operating the heating appliance C for cooking is provided forwardly of the control substrate 24.

The substrate 12 having the infrared sensor 10 and the light emitting element 11 both mounted thereon is accommodated within a metallic casing 26 made of a metallic material such as, for example, iron, non-magnetic stainless steel or aluminum, and a portion of a top surface of the metallic casing 26, which confronts a light receiving surface of the infrared sensor 10 and a light emitting surface of the light emitting element 11, is formed with an opening 26*c* through which radiation from the cooking container P passes and, also, rays of light emitted by the light emitting element 11 pass. The first light guide tube (a first light guide) 42*a* has a lower end positioned below the top surface of the metallic casing 26 and proximate to the filter 14 so as to increase the proportion of the infrared rays of light incident upon the infrared sensor 10 after having passed through the infrared permeable window 4*a*.

A portion of the top surface of the metallic casing 26 around the opening 26*c* is held in tight contact with a lower surface of a light guide tube holding member (a light guide holding member), to which the metallic casing 26 is fixed, to thereby avoid an undesirable ingress of light through a gap between the metallic casing 26 and the light guide tube holding member 40.

The metallic casing 26 is made up of an upper metallic casing part 26*a* and a lower metallic casing part 26*b* assembled together one above the other. The upper metallic casing part 26*a* and the lower metallic casing part 26*b* are each formed by bending a metal plate. Also, a portion of the upper metallic casing part 26*a* is bent outwardly to define a fixing piece 26*d*. Another portion of the upper metallic casing part 26*a* is bent inwardly to define an engagement piece (not shown), to which the substrate 12 is fixedly secured by means of set screws.

A portion of the top plate 4, through which the rays of light emitted from the light emitting unit 56*a* pass, is defined as a light emitting face 4*b* (see FIG. 6), which is a region through which the user can notice the light guided from the light emitting element 11 and illuminated through the light emitting unit 56*a*. The light emitting face 4*b* is, when viewed from top, positioned immediately above the light emitting unit 56*a*, but is, when the user views diagonally from front, positioned forwardly from top of the light emitting unit 56*a* because of the presence of parallax.

When a heating operation is instructed as a result of manipulation of the operating panel 28, the output signal from the infrared sensor 10 is converted by the temperature converting means 24*b* into a temperature of the cooking container P, but the output signal of the infrared sensor 10 may be directly outputted to the control unit 24*a* as temperature information without the temperature converting means 24*b* being employed. Based on the converted temperature or the output signal of the infrared sensor 10, the control unit 24*a* controls an inverter power source 30 for supplying a high frequency electric power to the heating coil 6, so that the temperature of the cooking container P can be adjusted to a value equal to or lower than a predetermined temperature.

Figure 3:
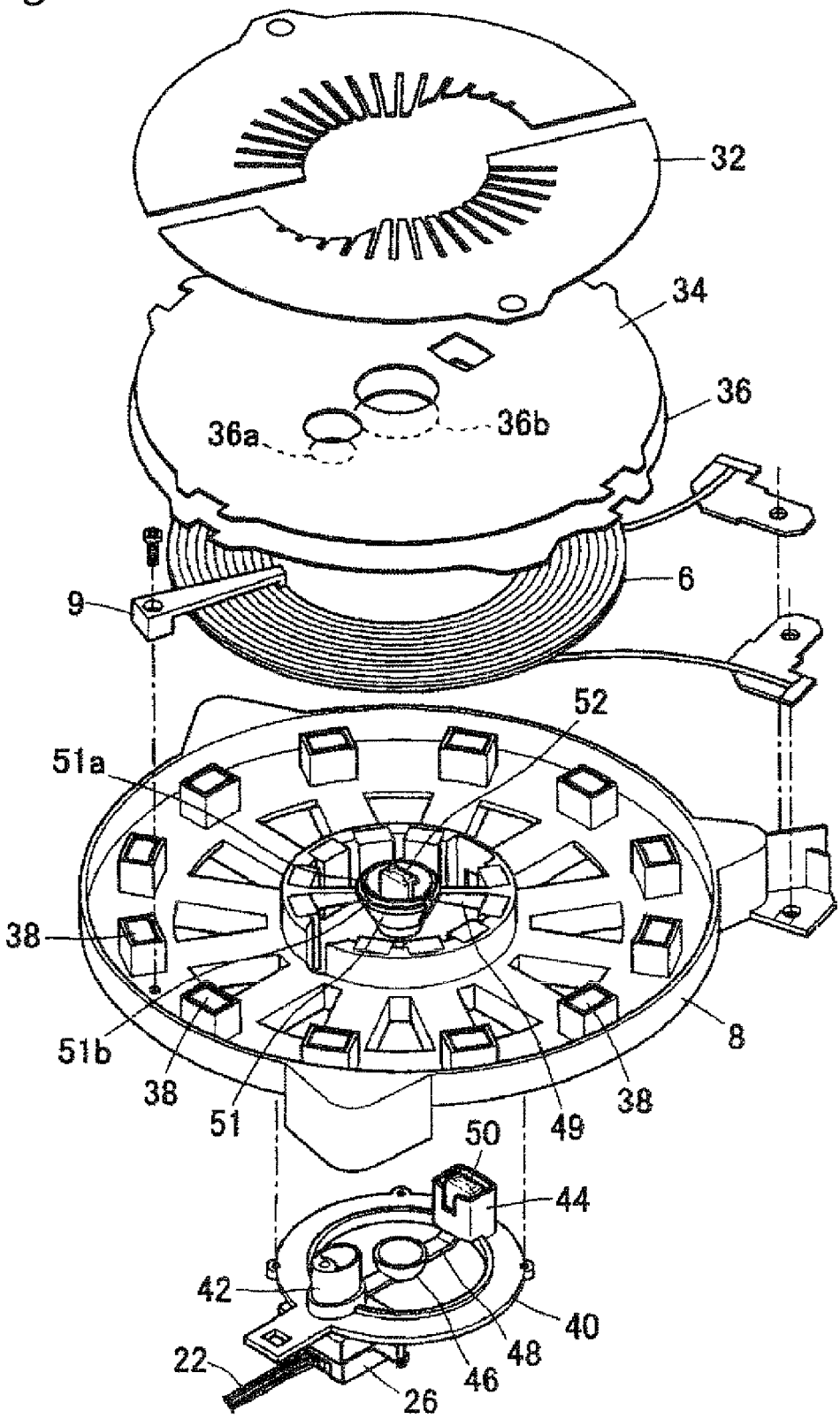
FIG. 3 is an exploded perspective view showing a portion of the induction heating appliance shown in FIG. 1.

As best shown in FIGS. 2 and 3, a buoyancy reducing plate 32 prepared from an aluminum plate of about 0.5 to 1.5 mm in thickness and operable to suppress buoyancy of the cooking container P which would occur when the cooking container P is heated, a heat insulating sheet 34 of about 2 mm in thickness and prepared from a heat insulating material such as, for example, ceramic fibers, and a mica plate 36 which is an electrically insulating plate of about 0.5 mm in thickness are placed above the heating coil 6 that is placed on and retained in the coil base 8, in this specified order from above. On the other hand, a plurality of radially extending ferrite cores 38 for concentrating magnetic fluxes, emanating from the heating coil 6 to the rear surface thereof, in an area adjacent the heating coil 6 is fitted to an undersurface of the coil base 8. Most of those ferrite cores 38 except for a portion thereof (as will be described later) represent a generally U-shaped configuration when viewed from the side, with opposite ends thereof bent upwardly. Each of those ferrite cores 38 has an outer end positioned radially outwardly of the heating coil 6 and also has an inner end radially inwardly of the heating coil 6.

The light guide tube holding member 40 referred to previously is made of a resinous material and is fitted to the undersurface of the coil base 8, and the metallic casing 26, accommodating therein the infrared sensor 10 as hereinbefore described, is secured to the light guide tube holding member 40 with the fixing piece 26*d* of the metallic casing 26 connected to a metallic casing fixing member 40*e* (see FIG. 5), which is formed in the light guide tube holding member 40, by means of a set screw. At this time, the light guide tube (light guide) 42 has its lower end inserted into the opening 26*c* and, as a result, a lower end of a lower outer wall 40*f* of the light guide tube 42 and a lower surface of an annular body 40*a* are held in tight contact with an upper surface of the metallic casing 26 so that the rays of light guided from the opening 26*c* into the metallic casing 26 can travel only along a path defined inside the light guide tube 42.

Figure 4:
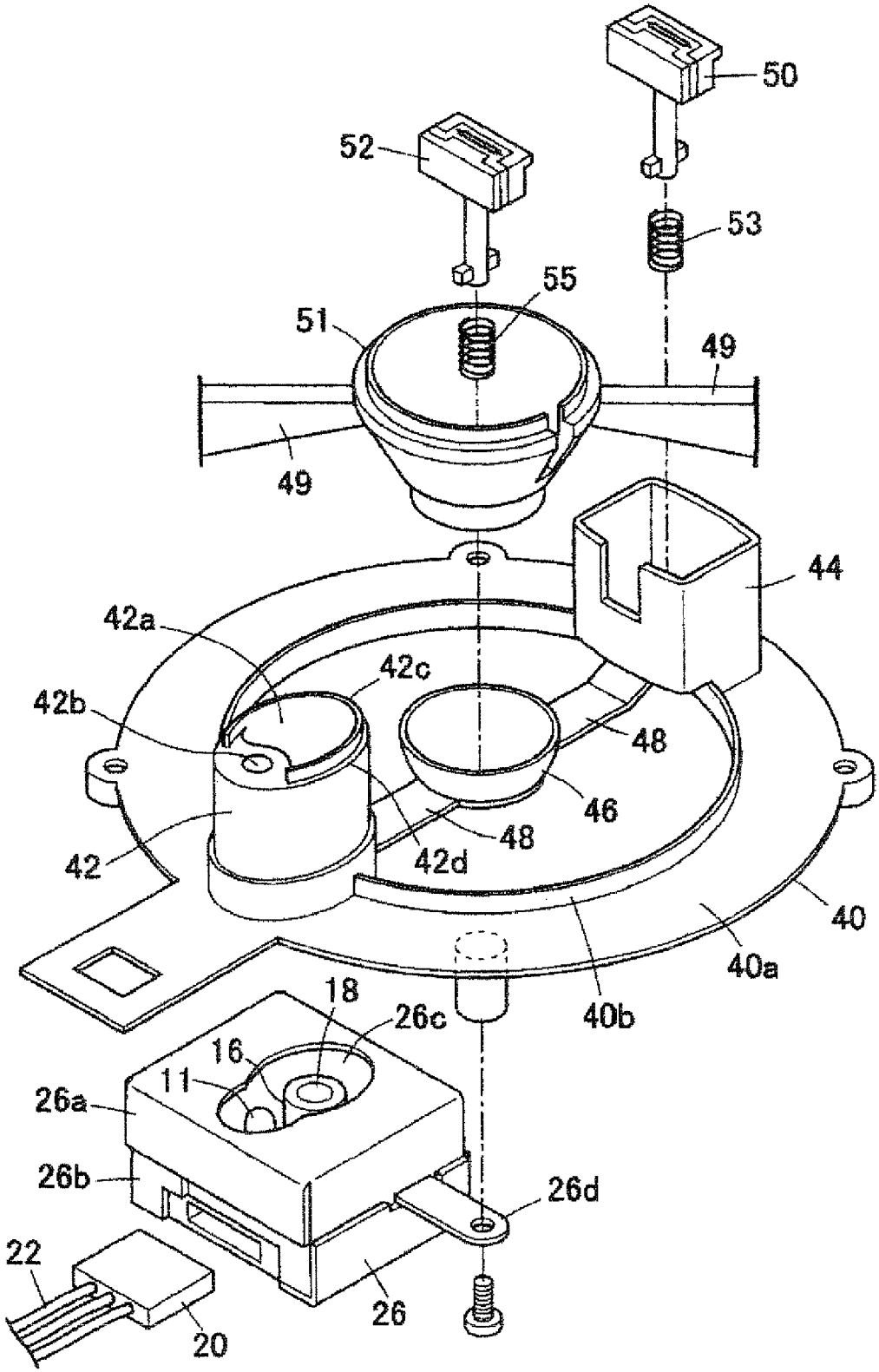
FIG. 4 is an exploded perspective view showing a light guide tube holding member employed in the induction heating appliance shown in FIG. 1.

Hereinafter, the structure of the light guide tube holding member 40 will be described in detail with particular reference to FIGS. 4 and 5.

The light guide tube holding member 40 is formed to represent an annular shape having a predetermined width and has the annular body 40*a* that is to be held in contact with the undersurface of the heating coil 6. The undersurface of the annular body 40*a* of the light guide tube holding member 40 is formed integrally with a convex reinforcement rib 40*h* protruding vertically downwardly from a portion thereof intermediate of the width of the annular body 40*a*. On an inner peripheral side of a front portion of the annular body 40*a*, the light guide 42, the metallic casing fixing member 40*e* and the light guide tube lower outer wall 40*f* are formed integrally therewith. At a location forwardly of the light guide tube 42, the front portion of the annular body 40*a* is formed with a wiring engagement segment 40*c* of predetermined width so as to extend radially outwardly, and a wiring engagement piece 40*d* of a generally L-sectioned configuration is formed integrally with a front end portion of the wiring engagement segment 40*c*. The metallic casing fixing member 40*e* is secured to a portion of the undersurface of the annular body 40*a* adjacent the light guide tube 42 so as to extend downwardly, and three light guide tube holder fixing members 40*g* are provided and distributed at three locations, respectively. The annular body 40*a* has a rear portion formed integrally with a first thermistor holding member 44 so as to extend vertically.

A center portion of the annular body 40*a*, that is, a portion of the annular body 40*a* between the light guide tube 42 and the first thermistor holding member 44 and immediately below a center portion of the heating coil 6 is integrally formed with a second thermistor covering 46 for covering a lower portion of a second thermistor holding member 51, together with a connecting member 48 connecting the second thermistor covering 46 and the annular body 40*a* together. The first and second thermistor holding members 44 and 46 accommodate therein first and second thermistors 50 and 52 together with coil springs 53 and 55, respectively, each coil spring 53 and 55 being formed in a configuration of a solenoid coil, as best shown in FIG. 1. As is the case with the infrared sensor 10, the first and second thermistors 50 and 52 are connected with the control unit 24*a* by means of associated lead lines (not shown) connected respectively with connectors.

The first and second thermistors 50 and 52 are each employed as a temperature detecting means for detecting the temperature of the cooking container P by means of a thermal conduction, and the first and second thermistors 50 and 53, accommodated in the respective holding members 44 and 51, are both biased towards the top plate 4 by means of the associated coil springs 53 and 55. The second thermistor holding member 51 is molded of a resinous material integrally with a coil base 8 and connecting members 49 and has its lower portion covered by the second thermistor covering 46 so that a current of cooling air entering the second thermistor holding member 51 through a perforation for engagement with an engagement portion of the second thermistor 52 will not cool the second thermistor 52.

Since the infrared sensor 10 has a transitional temperature response characteristic better than that of the thermistors 50 and 52, even in the case where the temperature of the bottom surface of the cooking container P abruptly increases when cooking such as, for example, frying up with a small quantity of oil is carried out, the temperature of the bottom of the cooking container P can be measured with high sensitivity in dependence on the output of the infrared sensor 10, and such a control can be accomplished that the heat output of the heating coil 6 can be quickly reduced immediately before the oil is fired and, also, the heat output can be quickly recovered when as a result of material to be cooked such as, for example, vegetables being put into the cooking container P the temperature of the latter is lowered. However, for the purpose of back-up in the event that the infrared sensor 10 is unable to detect the temperature of the cooking container P by reason of the cooking container P not placed above the infrared sensor 10, or in the event of malfunction of the infrared sensor 10, the thermistor 50 is employed and disposed at a location rearwardly of the center of the heating coil 6, and the thermistor 52 disposed at the center of the heating coil 6 is employed for temperature adjustment which may be carried out upon automatic setting of the temperature of the oil during the cooking of fried foods.

The annular body 40*a* of the light guide tube holding member 40 has an inner peripheral edge portion formed integrally with an upwardly oriented convex rib 40*b*, which is inserted so as to follow along inner end faces of the plurality of the ferrite cores 38 bonded to and retained in position on the rear surface of the coil base 8 by means of a bonding material. On the other hand, the plurality of the light guide tube holder fixing members 40*g* provided in the annular body 40*a* of the light guide tube holding member 40 are bonded to the coil base 8, thereby allowing inner end bottom faces and side faces of the ferrite cores 38 to be retained and positioned by the light guide holding member 40. Accordingly, the light guide tube holding member 40 concurrently functions as a mechanical holding member for the ferrite cores.

It is to be noted that since the light guide tube 42 and the first thermistor holding member 44 are partly positioned outside the rib 40*b*, the light guide tube 42 and one of the ferrite cores 38 corresponding in position to the first thermistor holding member 44 are partially cut out to avoid an undesirable interference with the light guide tube 42 and the first thermistor holding member 44. Accordingly, the ferrite core 38 having an inner end portion so cut out as hereinabove described has a length smaller than that of any other ferrite cores 38 and represents a generally L-shaped configuration when viewed from the side.

As best shown in FIG. 3, respective portions of the buoyancy reducing plate 32, the heat insulating sheet 34 and the mica plate 36, all positioned above the light guide tube 42 and the first thermistor holding member 44, are cut out so that they will not intercept passage of the infrared rays of light, then travelling from the cooking container P towards the infrared sensor 10 through the infrared radiation receiving member 43*a* defining the top opening of the light guide tube 42 and, also, so that the first and second thermistors 50 and 52 can, when extending therethrough, be held in contact with the rear surface of the top plate 4.

The light guide tube 42 has an oval sectional appearance and also has an interior thereof divided into two, with a first light guide tube segment 42*a* formed to guide the infrared rays of light, emanating from the cooking container P, towards the center of the heating coil 6. The first light guide tube segment 42*a* has an upper end including the infrared radiation receiving member 43*a* defining the opening confronting the top plate, an opening 43*b* at a lower end which open towards the infrared sensor 10, and an optical path 43*c* which is defined by a through hole extending between the infrared radiation receiving member 43*a* and the opening 43*b* at the lower end and through which the infrared rays of light travel so as to be incident on the infrared sensor 10. A second light guide tube segment 42*b* (second light guide) is also formed and positioned in the vicinity of an outer peripheral edge of the heating coil 6 relative to the first light guide tube segment 42*a* and forwardly of the center of the heating coil 6 for guiding light, emitted from the light emitting element 11, towards the top plate 4. Accordingly, the metallic casing 26 accommodating therein the infrared sensor 10 and the light emitting element 11 is secured to the light guide tube holding member 40 by means of screws with the infrared sensor 10 and the light emitting element 11 confronting the first light guide tube segment 42*a* and the lower end opening 43*b* of the second light guide tube segment 42*b*, respectively.

It is to be noted that the light guide tube 42 has an upper end formed with an upwardly oriented, horseshoe-shaped rib 42*c* extending along an outer periphery of the upper end of the light guide tube 42 with a step 42*d* of a predetermined width left outside of such horseshoe-shaped rib 42*c*. Positioned within the second light guide tube segment 42*b* is a light guide element 56 for efficiently guiding the light, emitted from the light emitting element 11, towards the light emitting unit 56*a* so that the light emerging outwardly from the light emitting unit 56*a* can be easily noticed.

As hereinabove described, the upper end of the light guide element 56 defines the light emitting unit 56*a* and projects the rays of light towards the rear surface of the top plate 4. When being placed above the heating coil 6, the mica plate 36 shown in FIG. 3 has the rib 42*c* engaged in a hole 36*a* defined in the mica plate 36 and also has an edge portion around the hole 36*a* placed on the step 42*d*. Similarly, the second thermistor holding member 51 of a generally semispherical container shape has its upper end portion formed with an upwardly oriented, generally annular rib 51*a* and a step 51*b* lying outside thereof, and the rib 51*a* of the holding member 51 is engaged in a hole 36*b* whereas an edge portion around the hole 36*b* is placed on the step 51*b*.

Figure 5:
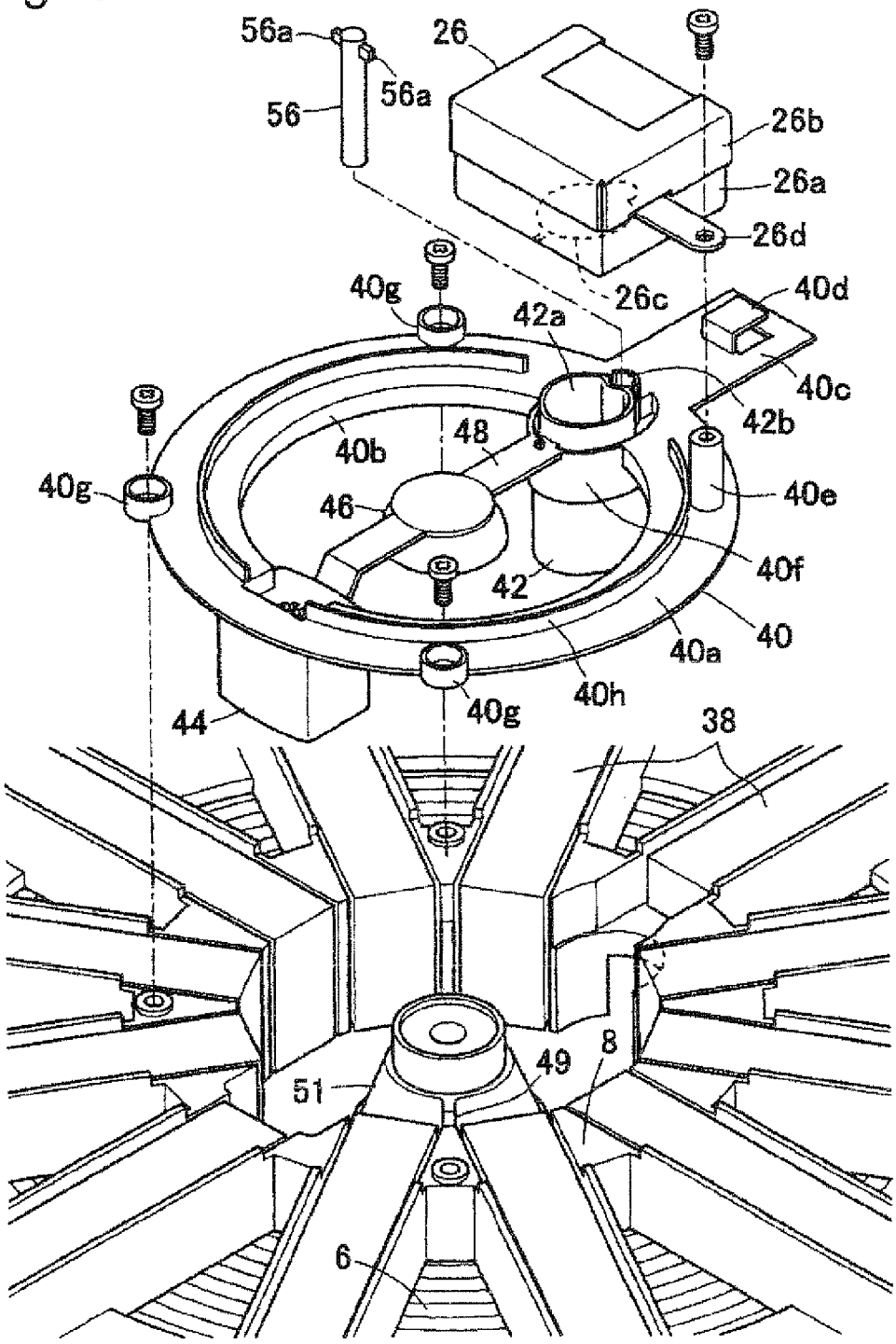
FIG. 5 is an exploded perspective view showing the light guide tube holding member shown in FIG. 4, which is viewed from below.

As best shown in FIGS. 5 and 6, the light guide element 56 is formed in a cylindrical shape and has its lower portion formed integrally with a pair of engagement pieces 56*a*, which are engaged respectively in a pair of cutouts 42*f* defined in a lower end portion of the second light guide tube segment 42*b* for the purpose of engaging the light guide element 56 with the second light guide tube segment 42*b*. This light guide element 56 is, before the metallic casing 26 is fitted to the light guide tube holding member 40, inserted from below into the second light guide tube segment 42*b*. It is to be noted that respective shapes of the buoyancy reducing plate 32, the heat insulating sheet 34 and the mica plate 36 are omitted and are not therefore shown in FIG. 6.

The operation of, and effects brought about by, the induction heating appliance C for cooking, which is so constructed as hereinbefore described, will now be described.

When an electric power switch (not shown) of the induction heating appliance C of the present invention is switched on in readiness for heating of the cooking container P, with a food material accommodated therein, the light emitting element 11 emits rays of light, which are subsequently guided through the light guide element 56 to illuminate the light emitting unit 56*a* and, accordingly, the light emitting surface 4*b* within the infrared permeable window 4*a* in the top plate 4 can be illuminated. Accordingly, the user can notice emission of light from the light emitting surface 4*b* within the infrared permeable window 4*a* encompassed within the infrared display window 4*g*, and placement of the cooking container P on the top plate 4 so as to cover the light emitting surface 4*b* allows the bottom of the cooking container P to assuredly cover the infrared permeable window 4*a* and, therefore, the infrared sensor 10 can assuredly receive infrared radiation emanating from the bottom of the cooking container P.

Also, since the infrared sensor 10 is arranged intermediate between the respective centers of the light emitting surface 4*b* and the heating area 5, and since the user places the cooking container P with the center of the heating area 5 and the light emitting surface 4*b* taken as a point of reference, the cooking container P can be further assuredly placed on the infrared permeable window 4*a* above the infrared sensor 10. Particularly where the environment is dark, the light emitting surface 4*b* can effectively draw attention of the user to the position of the infrared permeable window 4*a*.

When the start of heating is instructed by manipulation of the operating panel 28, the control unit 24*a* supplies a high frequency electric current to the heating coil 6 through the inverter power source 30. Upon supply of the high frequency electric current to the heating coil 6, the heating coil 6 generates an alternating current magnetic field, and the cooking container P is heated by induction with the temperature thereof increased consequently. As the temperature of the cooking container P increases, the cooking container P generally emits infrared energies in proportion to the fourth power of the absolute temperature thereof as exhibited by the Stefan-Boltzmann's law. The infrared radiation emitted from the cooking container P travels through the infrared permeable window 4*a* and then through the first light guide tube segment 42*a* and reaches the infrared sensor 10 after having passed through the filter 14 employed so as to cover the infrared sensor 10 for the purpose of removing unwanted rays of light.

Also, as the temperature of the cooking container P elevates, the output signal of the infrared sensor 10 then receiving the infrared radiation increases and, as hereinabove described, this output signal is, after having been amplified by the amplifier, supplied to the temperature converting means 24*b*, by which the output signal from the infrared sensor 10 is converted into the temperature of the cooking container P. In the event that the temperature of the cooking container P so converted exceeds the predetermined temperature, the control unit 24*a* interrupts the supply of the high frequency electric current, which has been outputted from the inverter power source 30 to the heating coil 6, or performs an adjustment to reduce the high frequency electric current.

When the infrared permeable window 4*a* is provided in the vicinity of an inner periphery of the heating coil 6, the infrared radiation receiving member 43*a* and the light emitting unit 56*a* are provided below the infrared permeable window 4*a* in adjoining relation to each other, and the infrared sensor 10 is disposed at a location on the imaginary straight line connecting the respective centers of the heating coil 6 and the light emitting unit 56*a* and intermediate between the respective centers of the heating coil 6 and the light emitting unit 56*a*, the infrared radiation emitted from that portion of the cooking container P at which the temperature attains a value higher than that above a center of the heating coil 6 can be caused to impinge upon the infrared sensor 10 and, with the center of the cooking container P brought as close to the center of the heating coil 6 as possible, the light emitting surface 4*b* illuminated by the light emitted from the light emitting unit 56*a* can be covered under the bottom of the cooking container P.

Accordingly, while the magnetic coupling between the heating coil 6 and the heating container P is increased, that is, while the heating efficiency is increased, it is possible to position the bottom surface of the cooking container P to be placed above the infrared permeable window 4*a*. Therefore, it is possible to assuredly perform the temperature control of the cooking container P relying on the infrared sensor 10 while the heating efficiency is increased, and not only can an abnormal heating of the cooking container P be suppressed to increase the safety factor, but also the cooking at the elevated temperature can be performed efficiently, thus resulting in an increase in usability.

Since in the embodiment hereinabove described, the infrared permeable window 4*a*, encompassed by the light shielding layer 7*b* and being narrower than the infrared sensor display window 4*g*, is formed inwardly of the infrared sensor display window 4*g*, the infrared sensor display window 4*g* can be presented on a large scale to the user so that the position of the infrared sensor can readily be noticed, and since the environment of the infrared permeable window 4*a* is firmly shielded by the light shielding layer 7*b* from light and since even though light of a high intensity dominates around the induction heating appliance C, it will hardly enter the infrared sensor 10, and it is possible to avoid reduction of the level of the infrared sensor 10 to detect the infrared rays of light emanating from the cooking container P.

Also, even though the cooking container P is placed on the top plate 4 in a fashion somewhat displaced from the infrared sensor display window 4*g*, an upper region above the infrared permeable window 4*a* provides an additional coverage that is accomplished by the cooking container such as, for example, a pan and, as a result, the temperature control can be stably performed even in the presence of a displacement of the cooking container, thus making it possible to provide an easy-to-handle heating appliance for cooking.

Also, when the use is made of the light transmissive, black colored printed thin film 7*c* for the infrared permeable window 4*a* and of the black colored light shielding layer of the same color at a location within the infrared sensor display window 4*g* and other than the infrared permeable window 4*a*, the inside of the infrared sensor display window 4*g* is colored in black and, accordingly, the infrared sensor display window 4*g* can be viewed by the user as a single component part, accompanied by an increase in visibility and design feature.

Since the top plate 4 is provided with the infrared sensor display window 4*g* for displaying a region surrounding at least a part of the infrared permeable window 4*a* so that the rays of light emitted from the light emitting unit 56*a* can be noticed within the region surrounding the infrared sensor display window 4*g*, the user, when associating the significance of light emission at the light emitting surface 4*b* and the presence of the infrared sensor 10 with the light emitting surface 4*b* and the infrared permeable window 4*a*, can readily recognize it.

Considering that the infrared permeable window 4*a* is positioned forwardly of the center of the heating coil 6, the rays of light from the light emitting unit 56*a*, which emits light at an outer peripheral edge of the heating coil 6 adjacent the infrared permeable window 4*a*, can be intercepted by the side wall of the cooking container P, when viewed from the side of the user doing cooking work, if the cooking container P is not positioned above the infrared permeable window 4*a*, and, therefore, the user can easily notice the light emission.

In addition, since the infrared permeable window 4*a* is positioned on the imaginary straight line (indicated by D in FIG. 7) passing across the center of the heating coil 6 in a direction perpendicular to the front surface of the heating appliance C, the rays of light from the light emitting unit 56*a*, which emits the light at the outer peripheral edge of the heating coil 6 in the vicinity of the infrared permeable window 4*a*, can be intercepted by the side wall of the cooking container P, when viewed from the side of the user doing cooking work, if the cooking container P is not positioned above the infrared permeable window 4*a*, and, therefore, the ease of handling the heating appliance C can be increased.

It is to be noted that although in describing the foregoing embodiment of the present invention, the colored printed thin film 7*a* and the black colored, printed thin film 7*c* have been shown and described as printed separately to color the top plate 4, the colored printed thin film 7*a* may be printed at a predetermined location beforehand, followed by printing of the black colored, printed film 7*c* over the substantially entire surface of the colored printed thin film 7*a*. All that are needed is that the infrared permeable window 4*a* surrounded by the light shielding layer 7*b* and being narrower than the infrared sensor display window 4*g*, can be formed inwardly of the infrared sensor display window 4*g*.

Second Embodiment

Figure 7:
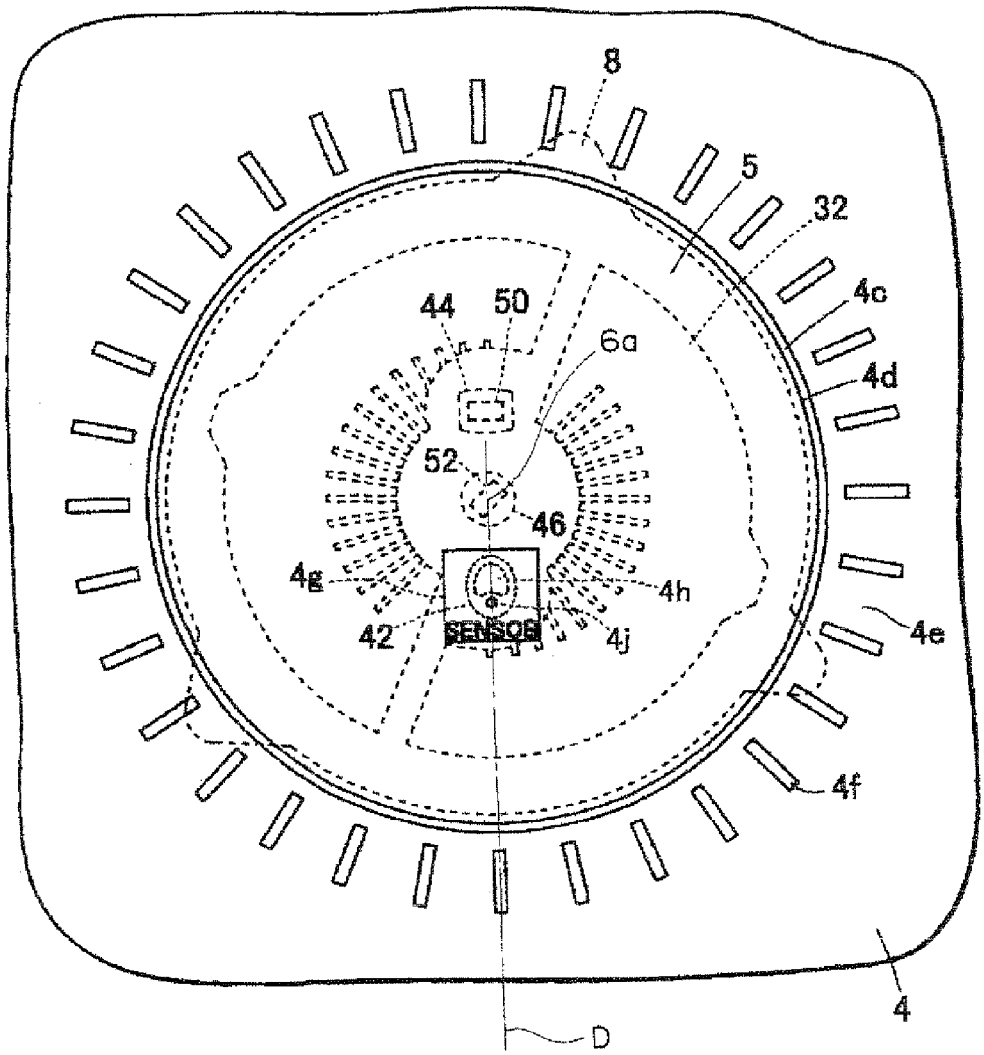
FIG. 7 is a fragmentary top plan view of a top plate according to a second preferred embodiment of the present invention.
Figure 8:
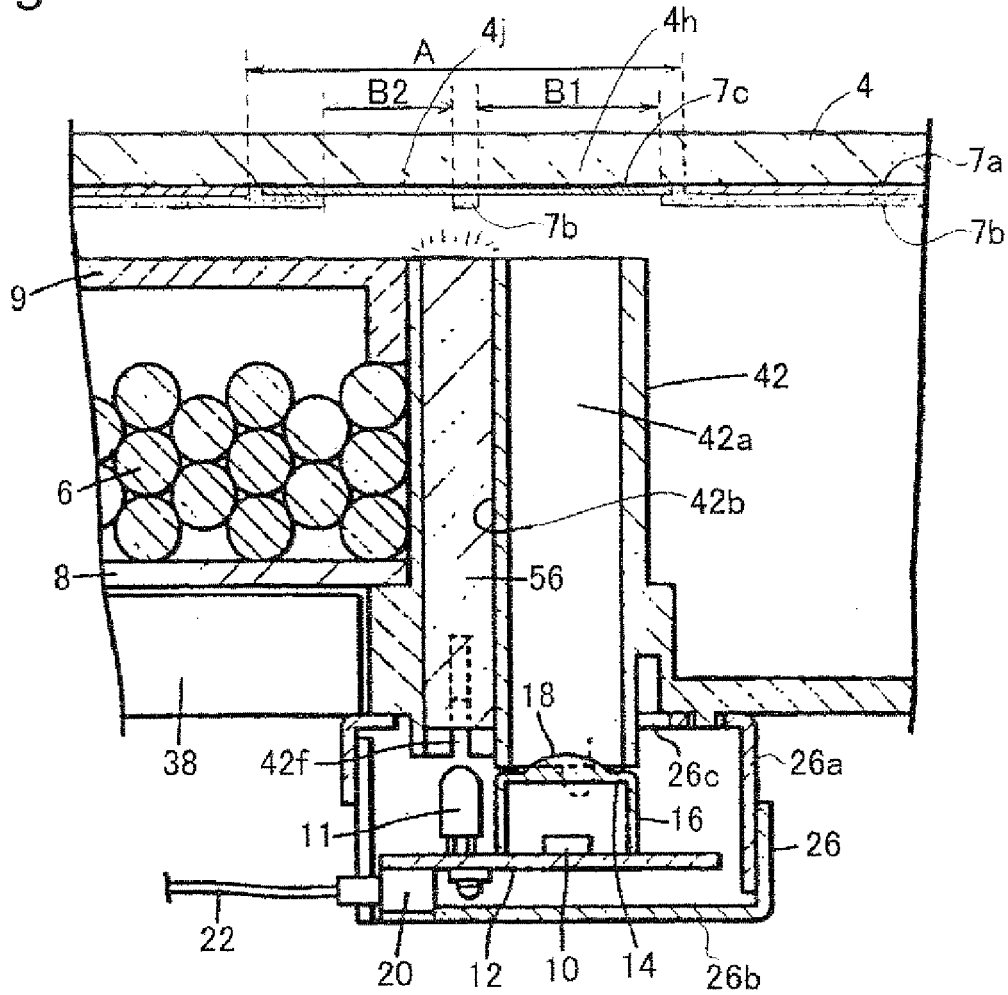
FIG. 8 is a fragmentary enlarged view showing a portion of an induction heating appliance, shown in FIG. 7, around an infrared sensor employed therein.

FIG. 7 illustrates a fragmentary top plan view showing the top plate employed in the induction heating appliance for cooking according to a second preferred embodiment of the present invention. FIG. 8 illustrates a fragmentary enlarged diagram showing the infrared sensor and its vicinity in the induction heating appliance for cooking. Component parts referred to hereinafter, but similar to those employed in the previously described embodiment of the present invention are designated by like reference numerals and, therefore, the details thereof are not reiterated for the sake of brevity.

Referring now to FIG. 7, a center front portion of the top plate 4 showing the heating area 5 has its rear surface provided with the black colored, printed thin film 7*c* (see FIG. 8) capable of transmitting light therethrough and formed with the infrared sensor display window 4*g* and represents a generally rectangular shape when viewed from above. In FIG. 8, a region indicated by A represents the infrared sensor display window 4*g*. The infrared sensor display window 4*g* is provided with an infrared permeable window 4*h*, which is a region opposed to the infrared radiation receiving member 43*a* forming an opening at the upper end of the first light guide tube segment 42*a* within that region (inside) and which is capable of passing infrared rays of light that are emitted from the cooking container P and are to be received by the infrared sensor 10. Also, a lighting window 4*j* is formed forwardly proximate to the infrared permeable window 4*h* and rays of light emitted from the light emitting unit 56*a* can be noticeable with eyes. The surroundings of the infrared permeable window 4*h* and the lighting window 4*j* are surrounded by a light shielding layer 7*b* as a light shielding segment. In FIG. 8, a region indicated by B1 represents the infrared permeable window 4*h* and a region indicated by B2 represents the lighting window 4*j*.

It is to be noted that in FIG. 8, the lighting window 4*j* in the region B2 is somewhat offset forwardly from the light emitting unit 56*a* of the light guide element 56 in consideration of the angle of sight of the user using the induction heating appliance from the front. Within the region of the infrared sensor display window 4*g*, a front portion of the lighting window 4*j*, which is the region in which emission of light at the end of the second light guide segment 42*b* can be noticed with eyes, bears a legend reading "SENSOR" and, accordingly, the user of the induction heating appliance can easily recognize that the infrared sensor display window 4*g* is a window indicative of the region where temperature measurement with the infrared sensor 10 takes place and that the lighting window 4*j* is representative of the region to be covered by the cooking container P that is placed thereon.

According to the foregoing construction shown in and described with reference to FIGS. 7 and 8, the infrared permeable window 4*b* can be used as a permeable window only for the infrared sensor 10 and, hence, the capability of shielding light around the infrared sensor can be increased, allowing influences on the infrared sensor 10, which are brought about by strong light around the induction heating appliance, to be further reduced. Also, although in this embodiment, the lighting window 4*j* is formed by the use of a printing technique (to form the black colored, printed thin film 7*c* capable of passing light therethrough) similar to that employed to form the infrared permeable window 4*h* and, hence, the user can not recognize the lighting window 4*j* unless the light emitting unit 56 lights, but elimination of printing to form the lighting window 4*j* or to use a different color such as, for example, brown color capable of passing light therethrough is employed therefor, makes it possible for the user to recognize the presence of the lighting window 4 even though the light emitting unit 56*a* fails to light.

Third Embodiment

Figure 9:
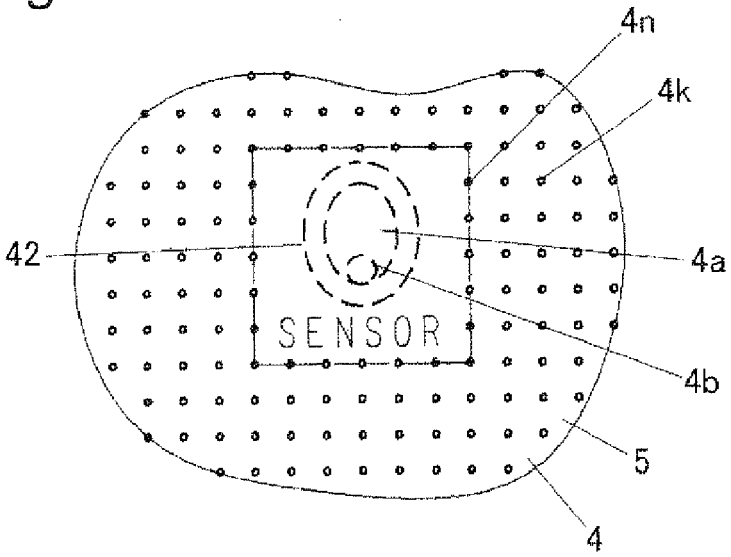
FIG. 9 is a fragmentary top plan view showing a top plate according to a third preferred embodiment of the present invention.
Figure 10:
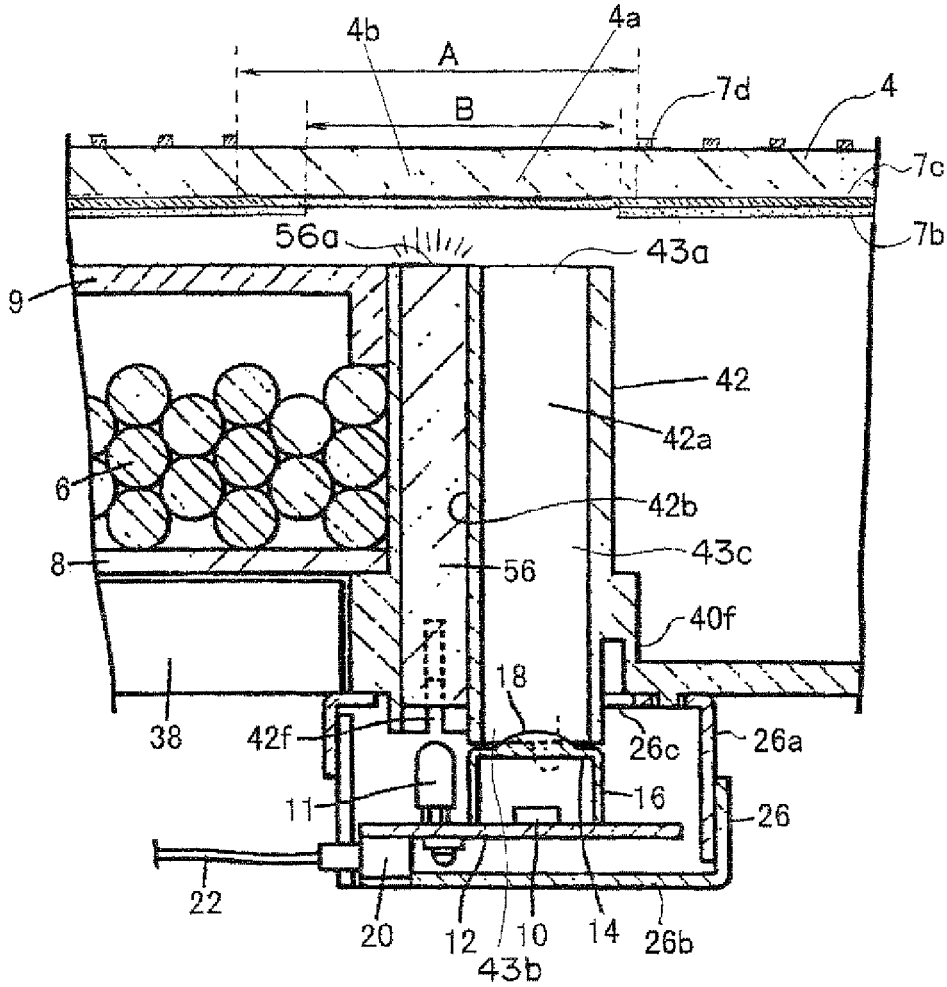
FIG. 10 is fragmentary enlarged view showing a portion of an induction heating appliance, shown in FIG. 9, around an infrared sensor employed therein.

FIG. 9 illustrates a fragmentary top plan view of the top plate employed in the induction heating appliance according to a third preferred embodiment of the present invention. FIG. 10 is a fragmentary enlarged view showing the infrared sensor and its vicinity in the induction heating appliance shown in FIG. 9. Component parts referred to hereinafter, but similar to those employed in the previously described embodiment of the present invention are designated by like reference numerals and, therefore, the details thereof are not reiterated for the sake of brevity.

Referring to FIG. 9, the rear surface of the top plate 4, which shows the presence of the heating area 5, has a black colored, printed thin film 7*c* (see FIG. 10) capable of passing light therethrough, which is provided over substantially the entire surface thereof. On the other hand, the table top surface of the top plate 4 opposite to the rear surface referred to above is formed with an infrared sensor display window 4*n* of a generally rectangular shape, when viewed from above, by means of a front printed film 7*d* formed by dots 4*k* and characters. In FIG. 10, a region indicated by A represents the infrared sensor display window 4.

The infrared sensor display window 4*n* is provided with an infrared permeable window 4*a* capable of passing therethrough infrared rays of light emanating from the cooking container P and to be received by the infrared sensor 10, in a region opposed to the infrared radiation receiving member 43*a* defining the upper end opening of the first light guide tube segment 42*a* within that region. A region indicated by B in FIG. 10 represents the infrared permeable window 4*a*.

The infrared permeable window 4*a* is surrounded by the light shielding layer 7*b* employed as a light shielding member. Also, the infrared permeable window 4*a* is so formed as to encompass the light emitting surface 4*b* from which rays of light emitted from the light emitting unit 56*a* can be noticed with eyes.

Within the region of the infrared sensor display window 4*n*, a front portion of the light emitting surface 4*b*, at which emission of light at the end of the second light guide segment 42*b* can be noticed with eyes, is formed with a legend reading "SENSOR" expressed by means of the front printed film 7*d* and, accordingly, the user of the induction heating appliance can easily recognize that the infrared sensor display window 4*n* is a window indicative of the region where temperature measurement with the infrared sensor 10 takes place and that the light emitting surface 4*b* is representative of the region to be covered by the cooking container P that is placed thereon.

According to the third embodiment of the present invention so constructed as hereinabove described, the colored printed thin film 7*a* employed in the practice of the first embodiment of the present invention as hereinbefore described is eliminated and the infrared sensor display window 4*n* is instead formed by means of the inexpensive front printed film 7*d*, accompanied by a reduction in cost. Also, since the front printed film 7*d* is formed on the table top surface of the top plate, such an advantage can be appreciated that even if the angle of view changes, parallax in recognizing will not occur in contrast to the rear surface printing.

It is to be noted that although in describing the third embodiment of the present invention, the region of the infrared sensor display window 4*n* is defined by the dots 4*k*, the infrared sensor display window 4*n* may be defined by means of lines and all that are needed is that the infrared sensor display window 4*n* can be recognized by the user in any way whatsoever.

Figure 11:
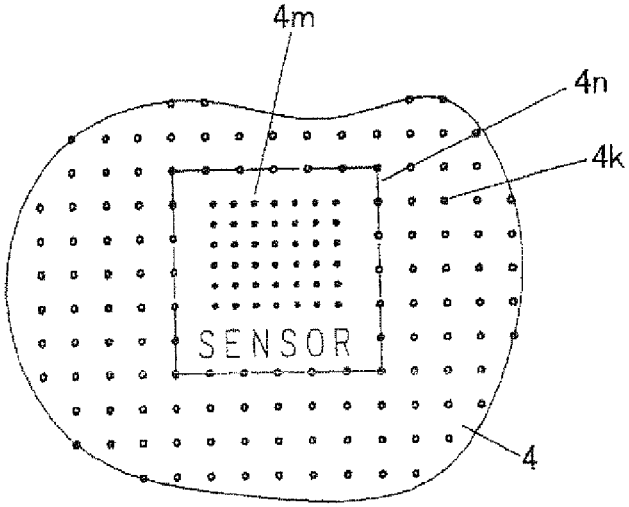
FIG. 11 is fragmentary enlarged view showing a portion of an induction heating appliance according to a further preferred embodiment of the present invention around an infrared sensor employed therein.

It is also to be noted that in any one of the first to third embodiments of the present invention discussed hereinbefore, the infrared sensor display window may have a printed design feature incorporated therein. By way of example, FIG. 11 shows the printing of dots 4*m* in the infrared sensor display window 4*n* employed in the third embodiment of the present invention. In any event, any printed pattern may be employed provided that the presence of the infrared sensor display window can readily be recognized by the user.

Furthermore, although in describing any one of the first to third embodiments of the present invention, the infrared permeable window 4*a* has been shown and described as provided in the vicinity of the inner periphery of the heating coil 6, it may be disposed at the center of the heating coil 6, or similar effects can be obtained provided that the infrared permeable window 4*a* is formed inwardly of the infrared sensor display window 4*g* and surrounded by the light shielding layer 7*b* so as to have a size narrower than the infrared sensor display window 4*g*.

In addition, although the light shielding layer 7*b* of a single layer structure is shown and described as employed in the practice of any one of the first to third embodiments of the present invention, the use of the light shielding layer 7*b* of a multilayered structure within the heating area 5 is effective in that even when the environment of the induction heating appliance C is particularly bright, it is possible to effectively avoid undesirable entry of the ambient light into the infrared sensor 10, which may lead to a reduction in detection level of the infrared sensor 10.

Yet, although in any one of the first to third embodiments of the present invention described hereinbefore, the infrared permeable window 4*a* has been shown and described as formed inwardly of the infrared sensor display window, it will not have too much effect on a reduction in performance even if the infrared permeable window 4*a* is exposed outwardly from the infrared sensor display window only at a location rearwardly of the infrared sensor display window.

As hereinbefore fully described, the induction heating appliance of the present invention includes a body 2 forming an outer shell, a top plate 4 mounted on a top area of the body 2 and made of a material of a kind capable of passing infrared rays of light therethrough, a heating coil 6 arranged beneath the top plate 4 in face to face relation with the top plate 4 for generating high frequency magnetic fields necessary to heat by induction a bottom of a cooking container P placed on the top plate 4, an infrared sensor 10 for detecting infrared radiation emanating from the bottom of the cooking container P in a direction below an infrared permeable window 4*a*, 4*h*, a first light guide segment 42*a* (light guide element) including an infrared radiation receiving member 43*a* having an opening formed therein in face to face relation with the top plate 4 and also having an optical path 43*c* defined therein for passing therethrough the infrared rays of light incident from the infrared radiation receiving member 43*a* towards the infrared sensor 10, a light emitting unit 56*a* for emitting visible rays of light towards a rear surface of the top plate 4, and a control unit 24*a* for controlling an output of the heating coil based on an output signal of the infrared sensor 10. The top plate 4 has a table top surface or a rear surface printed with an infrared sensor display window 4*g*, 4*n* for displaying a region where the infrared incident area 43 exists, and an infrared permeable window 4*a*, 4*h*, which represents a region surrounded by a light shielding layer 7*b* (light shielding element) and is narrower than the infrared sensor display window 4*g*, 4*n* is formed inwardly of the infrared sensor display window 4*g*, 4*n*. Also, the light emitting unit is provided below the infrared permeable window 4*a*, 4*h* so that light emission of the light emitting unit at a location inwardly of the infrared permeable window 4*a*, 4*h* can be noticed with eyes. By this configuration, the infrared permeable window 4*a*, 4*h* surrounded by the light shielding element and formed at a location inwardly of the infrared sensor display window 4*g*, 4*n* suppresses an ingress of strong ambient light (external disturbing light) around the induction heating appliance into the infrared sensor 10 to thereby avoid reduction of the performance in detecting the infrared rays of light emanating from the cooking container P, which would be brought about by the ambient light.

If the light shielding layer 7*b* is so designed as to be a film having a large light absorbing capability and of a black color or any other color (such as, for example, gray or brown) nearly similar to a dark black color, transmittance of the ambient light after the latter has been reflected within the inside of the top plate 4 can be suppressed and, therefore, an effect of avoiding an undesirable ingress of the ambient light from the infrared incident member 43 can be further increased.

To the user, the infrared sensor display window 4*g*, 4*n* can be displayed large in size to provide a clear indication of the position of the infrared sensor 10. Also, even when the cooking container P is somewhat displaced from the infrared sensor display window 4*g*, 4*n*, the upper surface of the infrared permeable window 4*a*, 4*h* can have an additional coverage for the cooking container P to cover it and, as a result, the temperature control can be performed stably relative to the displacement of the cooking container P, accompanied by an increase in usability.

Also, when the design is employed in which the rear surface of the lighting window 4*j* is illuminated by the rays of light emitted from the light emitting unit 56*a* so that the light emission of the light emitting unit can be noticed inside the infrared permeable window 4*a*, 4*h*, the position of the infrared sensor can be accurately acknowledged to the user and the cooking container such as, for example, a pan can be assuredly placed at the position at which the cooking container covers the infrared sensor incident member 43*a*. Particularly where the environment is dark, it is indeed effective for the position of the infrared sensor 10 to be acknowledged with the light emitting unit 56*a*.

Furthermore, the infrared sensor display window 4*g*, 4*n* is fitted to the table top surface or the rear surface of the top plate 4, and the infrared permeable window 4*a*, 4*h*, through which the infrared rays of light transmit, and the lighting window 4*j* are separately formed inwardly of the infrared sensor display window 4*g*, 4*n*. Also, the light emitting unit is provided below the lighting window 4*j* so that the rear surface of the lighting window can be illuminated by the rays of light emitted from the light emitting unit. By this configuration, the infrared permeable window 4*a*, 4*h* can be rendered to be a light permeable window dedicated to the infrared sensor, independently of the light permeable window dedicated to the light emitting unit. Therefore, the capability of shielding light around an upper portion of the infrared radiation receiving member can be increased and the influence of the strong ambient light around the induction heating appliance on the infrared sensor can be reduced accordingly.

It is to be noted that since if the light shielding member is so designed as to be a film having a large light absorbing capability and of a black color or any other color (such as, for example, gray or brown) nearly similar to a dark black color, transmittance of the ambient light after the latter has been reflected inside the top plate can be suppressed, an effect of avoiding an undesirable ingress of the ambient light from the infrared radiation receiving member can be further increased.

As hereinbefore fully described, the induction heating appliance for cooking according to the present invention makes it possible to inform the user of the position of the infrared sensor and, hence, makes it possible for the user to place the cooking container such as, for example, a pan assuredly at a position where it covers the permeable window for the infrared sensor. Also, since the temperature of the cooking container can be controlled with the use of the infrared sensor and, at the same time, the usability is excellent, the present invention can be equally applied to an induction heating appliance for cooking for home use and also to that for official use.

The invention claimed is:

1. An induction heating appliance for cooking, which comprises:

a body forming an outer shell;

a top plate mounted on a top area of the body and made of a material of a kind capable of passing infrared rays of light therethrough;

a heating coil arranged beneath the top plate in face to face relation with the top plate for generating high frequency magnetic fields necessary to heat by induction a bottom of a cooking container placed on the top plate;

an infrared sensor operable to detect infrared radiation emanating from the bottom of the cooking container in a direction below an infrared permeable window;

a light guide element including an infrared radiation receiving member having an opening formed therein in face to face relation with the top plate and also having an optical path defined therein for passing therethrough the infrared rays of light incident from the infrared radiation receiving member towards the infrared sensor;

a light emitting unit operable to emit visible rays of light towards a rear surface of the top plate; and a control unit operable to control an output of the heating coil based on an output signal of the infrared sensor;

wherein the top plate has a table top surface or a rear surface provided with an infrared sensor display window, and the infrared permeable window, which represents a region surrounded by a light shielding element and is narrower than the infrared sensor display window, is formed inwardly of the infrared sensor display window; and wherein the light emitting unit is provided below the infrared permeable window so that light emission of the light emitting unit at a location inwardly of the infrared permeable window is noticed with eyes.

2. An induction heating appliance for cooking, which comprises:

a body forming an outer shell;

a top plate mounted on a top area of the body and made of a material of a kind capable of passing infrared rays of light therethrough;

a heating coil arranged beneath the top plate in face to face relation with the top plate for generating high frequency magnetic fields necessary to heat by induction a bottom of a cooking container placed on the top plate;

an infrared sensor operable to detect infrared radiation emanating from the bottom of the cooking container in a direction below an infrared permeable window;

a light guide element including an infrared radiation receiving member having an opening formed therein in face to face relation with the top plate and also having an optical path defined therein for passing therethrough the infrared rays of light incident from the infrared radiation receiving member towards the infrared sensor;

a light emitting unit operable to emit visible rays of light towards a rear surface of the top plate; and a control unit operable to control an output of the heating coil based on an output signal of the infrared sensor;

wherein the top plate has a table top surface or a rear surface provided with an infrared sensor display window by printing, which infrared sensor display window provides a visual indication of a region indicative of the position at which an infrared radiation receiving member is located, and the infrared permeable window, which represents a region surrounded by a light shielding element and is narrower than the infrared sensor display window, and a lighting window are separately formed inwardly of the infrared sensor display window; and wherein the light emitting unit is provided below the lighting window so that light emitted by the light emitting unit is projected onto a rear surface of the lighting window.

* * * * *